US010117040B2

(12) United States Patent
Seo et al.

(10) Patent No.: US 10,117,040 B2
(45) Date of Patent: Oct. 30, 2018

(54) AUDIO SYSTEM AND METHOD OF EXTRACTING INDOOR REFLECTION CHARACTERISTICS

(71) Applicant: Electronics and Telecommunications Research Institute, Daejeon (KR)

(72) Inventors: Jeong Il Seo, Daejeon (KR); Tae Jin Park, Daejeon (KR); Jae Hyoun Yoo, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/144,556

(22) Filed: May 2, 2016

(65) Prior Publication Data

US 2016/0381486 A1 Dec. 29, 2016

(30) Foreign Application Priority Data

Jun. 25, 2015 (KR) ..... 10-2015-0090351

(51) Int. Cl.
*H04S 7/00* (2006.01)

(52) U.S. Cl.
CPC ..... *H04S 7/305* (2013.01); *H04S 7/301* (2013.01); *H04S 7/40* (2013.01)

(58) Field of Classification Search
CPC . H04S 7/305; H04S 7/301; H04S 7/40; H04S 7/307; H04S 7/30; H04S 3/00; H04S 2420/03; G10L 19/008
See application file for complete search history.

(56) References Cited

U.S. PATENT DOCUMENTS

| | | | |
|---|---|---|---|
| 5,398,003 | A | 3/1995 | Heyl et al. |
| 6,111,957 | A | 8/2000 | Thomasson |
| 6,434,194 | B1 | 8/2002 | Eisenberg et al. |
| 7,103,187 | B1 | 9/2006 | Neuman |
| 8,223,992 | B2 | 7/2012 | Suzuki et al. |
| 8,325,952 | B2 | 12/2012 | Cho |
| 8,363,851 | B2 | 1/2013 | Suzuki |
| 8,594,350 | B2 | 11/2013 | Hooley et al. |
| 8,638,959 | B1 | 1/2014 | Hall |
| 2001/0043652 | A1 | 11/2001 | Hooley |
| 2005/0271150 | A1 | 12/2005 | Moore et al. |
| 2006/0050891 | A1 | 3/2006 | Bharitkar |

(Continued)

FOREIGN PATENT DOCUMENTS

| | | | |
|---|---|---|---|
| JP | 2005-159518 | A | 6/2005 |
| JP | 2006-13711 | A | 1/2006 |

(Continued)

*Primary Examiner* — Jason R Kurr
(74) *Attorney, Agent, or Firm* — NSIP Law

(57) ABSTRACT

An audio system and method of extracting indoor reflection characteristics, the method including generating a detection signal based on an input signal and a modulation code, outputting a sound signal generated based on the detection signal through a plurality of speakers, measuring sound signals output through the plurality of speakers, or sound signals reflected by a wall of a space in which the plurality of speakers is installed, and extracting reflection characteristics of the space based on the measured sound signals and the modulation code, is disclosed.

15 Claims, 10 Drawing Sheets

(56) References Cited

U.S. PATENT DOCUMENTS

| | | | | |
|---|---|---|---|---|
| 2006/0062399 | A1 | 3/2006 | Cooper et al. | |
| 2006/0148519 | A1 | 7/2006 | Simpson et al. | |
| 2006/0153391 | A1* | 7/2006 | Hooley | H04S 7/301 381/17 |
| 2006/0256970 | A1 | 11/2006 | Asada et al. | |
| 2006/0262940 | A1 | 11/2006 | Asada | |
| 2007/0036366 | A1 | 2/2007 | Konagai et al. | |
| 2007/0086597 | A1 | 4/2007 | Kino | |
| 2008/0165993 | A1* | 7/2008 | Cho | H04S 7/301 381/307 |
| 2011/0091042 | A1 | 4/2011 | Ko et al. | |
| 2012/0070021 | A1 | 3/2012 | Yoo et al. | |
| 2012/0086597 | A1 | 4/2012 | Sin et al. | |
| 2012/0288124 | A1 | 11/2012 | Fejzo et al. | |
| 2013/0058492 | A1 | 3/2013 | Silzle et al. | |
| 2013/0170652 | A1 | 7/2013 | Yoo et al. | |
| 2013/0230180 | A1 | 9/2013 | Thormundsson et al. | |
| 2013/0243211 | A1* | 9/2013 | Kondo | H04R 3/04 381/63 |
| 2014/0205100 | A1 | 7/2014 | Faller et al. | |
| 2014/0358532 | A1 | 12/2014 | Lin | |
| 2014/0369529 | A1 | 12/2014 | Quinn | |
| 2015/0263692 | A1* | 9/2015 | Bush | H03G 5/165 381/122 |
| 2015/0312690 | A1* | 10/2015 | Yuyama | H04R 29/002 381/59 |

FOREIGN PATENT DOCUMENTS

| | | | |
|---|---|---|---|
| JP | 2012242597 | A | 12/2012 |
| KR | 1020130068251 | A | 6/2013 |
| KR | 10-2016-0040891 | A | 4/2016 |
| WO | 0134264 | A1 | 5/2001 |

* cited by examiner

FIG. 8

810 800

| | | | | | | | |
|---|---|---|---|---|---|---|---|
| 1 | 1 | 1 | 1 | 1 | 1 | 1 | 1 |
| 1 | -1 | 1 | -1 | 1 | -1 | 1 | -1 |
| 1 | 1 | -1 | -1 | 1 | 1 | -1 | -1 |
| 1 | -1 | -1 | 1 | 1 | -1 | -1 | 1 |
| 1 | 1 | 1 | 1 | -1 | -1 | -1 | -1 |
| 1 | -1 | 1 | -1 | -1 | 1 | -1 | 1 |
| 1 | 1 | -1 | -1 | -1 | -1 | 1 | 1 |
| 1 | -1 | -1 | 1 | -1 | 1 | 1 | -1 |

AUDIO SYSTEM AND METHOD OF EXTRACTING INDOOR REFLECTION CHARACTERISTICS

CROSS-REFERENCE TO RELATED APPLICATION

This application claims the priority benefit of Korean Patent Application No. 10-2015-0090351, filed on Jun. 25, 2015, in the Korean Intellectual Property Office, the disclosure of which is incorporated herein by reference.

BACKGROUND

1. Field of the Invention

Embodiments relate to an audio system and method of outputting multi-channel audio signals, and more particularly, to an audio system and method of extracting reflection characteristics of a space in which the audio system is installed, optimizing multi-channel audio signals based on the extracted reflection characteristics, and outputting the optimized audio signals.

2. Description of the Related Art

Audio systems to reproduce sound fields using a plurality of speakers are being developed. One of the audio systems outputs sound beams toward a wall of a space in which the audio system is installed through a speaker array including a plurality of speakers, thereby providing an effect similar to a virtual speaker being present on the wall using a sound beam reflected by the wall.

An optimal angle at which a sound beam is to be reflected varies depending on an area of the space, a shape of the wall, a size of the wall, and a position of a user. Thus, an existing audio system includes a separate sound sensor, estimates sound characteristics by measuring a sound pressure corresponding to a sound beam using the sound sensor while changing a direction of the sound beam, and determines an angle of the sound beam optimized for a position of a user and a space in which the audio system is installed.

However, the existing audio system needs to measure a level of the sound pressure while changing a direction of each sound beam, and thus a plenty of measurement time is needed. Further, in a case in which noise enters while the sound pressure is measured, a position at which the sound pressure increases may change. Thus, a non-optimal angle may be determined to be an optimized angle of the sound beam.

Accordingly, there is demanded a method of quickly measuring reflection characteristics of a space in which an audio system is installed, and minimizing an effect of noise.

SUMMARY

Embodiments provide an apparatus and method that may measure sound signals output based on detection signals generated based on an input signal and a modulation code, and extract reflection characteristics of a space in which speakers are installed based on the measured sound signals and the modulation code, thereby outputting an audio signal optimized for the space.

Embodiments also provide an apparatus and method that may output sound signals through a plurality of speakers simultaneously based on a detection signal, thereby outputting an audio signal robust to external noise.

According to an aspect, there is provided a method of extracting reflection characteristics, the method including generating a detection signal based on an input signal and a modulation code, outputting a sound signal generated based on the detection signal through a plurality of speakers, measuring sound signals output through the plurality of speakers, or sound signals reflected by a wall of a space in which the plurality of speakers is installed, and extracting reflection characteristics of the space based on the measured sound signals and the modulation code.

The generating of the detection signal may include generating a plurality of channels based on a single-channel input signal, and generating the detection signal by modulating at least one of the plurality of channels based on the modulation code.

The generating of the detection signal may include generating the detection signal by reversing a polarity of at least one of the plurality of channels based on the modulation code.

The generating of the detection signal may include generating the detection signal by activating at least one of the plurality of channels based on the modulation code.

The modulation code may be a digital modulation code to control whether the plurality of channels is to be activated or deactivated, or whether polarities of the plurality of channels are to be reversed.

The modulation code may be configured using a combination of codes respectively to control whether the plurality of channels is to be activated or deactivated, or whether polarities of the plurality of channels are to be reversed.

The outputting may include generating a non-directional signal based on the detection signal and outputting the non-directional signal through the plurality of speakers.

The extracting may include generating a characteristic image of sound propagation based on the measured sound signals and the modulation code, and verifying the reflection characteristics of the space based on the characteristic image of sound propagation.

The generating of the characteristic image of sound propagation may include generating a two-dimensional (2D) characteristic image of sound propagation with axes of a time and a radiation angle.

The verifying may include applying a feature point extracting algorithm to the generated characteristic image of sound propagation.

According to another aspect, there is also provided a method of generating an audio signal, the method including receiving reflection characteristics of a space in which a plurality of speakers is installed, generating an audio signal optimized for the space by modulating an audio signal based on the reflection characteristics, and generating a first sound signal based on the optimized audio signal and outputting the sound signal through the plurality of speakers.

The reflection characteristics may be extracted by generating a 2D characteristic image of sound propagation with axes of a time and a radiation angle based on a second sound signal and a modulation code, and applying a feature point extracting algorithm to the characteristic image of sound propagation, and the second sound signal may be generated based on a detection signal generated based on an input signal and the modulation code.

According to still another aspect, there is also provided an apparatus for extracting reflection characteristics, the apparatus including a detection signal generator configured to generate a detection signal based on an input signal and a modulation code, a sound signal outputter configured to generate a sound signal based on the detection signal and output the generated sound signal through a plurality of speakers, a sound signal measurer configured to measure sound signals output through the speakers, or sound signals reflected by a wall of a space in which the speakers are installed, and a reflection characteristic extractor configured to extract reflection characteristics of the space based on the measured sound signals and the modulation code.

The detection signal generator may be configured to generate a plurality of channels based on a single-channel input signal, and generate the detection signal by modulating at least one of the plurality of channels based on the modulation code.

The detection signal generator may be configured to generate the detection signal by reversing a polarity of at least one of the plurality of channels based on the modulation code.

The detection signal generator may be configured to generate the detection signal by activating at least one of the plurality of channels based on the modulation code.

The sound signal outputter may be configured to generate a non-directional signal based on the detection signal and output the non-directional signal through the plurality of speakers.

The reflection characteristic extractor may be configured to generate a 2D characteristic image of sound propagation with axes of a time and a radiation angle, based on the measured sound signals and the modulation code, and verify the reflection characteristics of the space by applying a feature point extracting algorithm to the 2D characteristic image of sound propagation According to yet another aspect, there is also provided an apparatus for generating an audio signal, the apparatus including a reflection characteristic receiver configured to receive reflection characteristics of a space in which a plurality of speakers is installed, an audio signal generator configured to generate an audio signal optimized for the space by modulating an audio signal based on the reflection characteristics, and a sound signal outputter configured to generate a first sound signal based on the optimized audio signal and output the sound signal through the plurality of speakers.

The reflection characteristics may be extracted by generating a 2D characteristic image of sound propagation with axes of a time and a radiation angle based on a second sound signal and a modulation code, and applying a feature point extracting algorithm to the characteristic image of sound propagation, and the second sound signal may be generated based on a detection signal generated based on an input signal and the modulation code.

BRIEF DESCRIPTION OF THE DRAWINGS

These and/or other aspects, features, and advantages of the invention will become apparent and more readily appreciated from the following description of embodiments, taken in conjunction with the accompanying drawings of which:

FIG. 8 is a diagram illustrating an example of a pattern set in which digital modulation codes are combined according to an embodiment;

DETAILED DESCRIPTION

Figure 1:
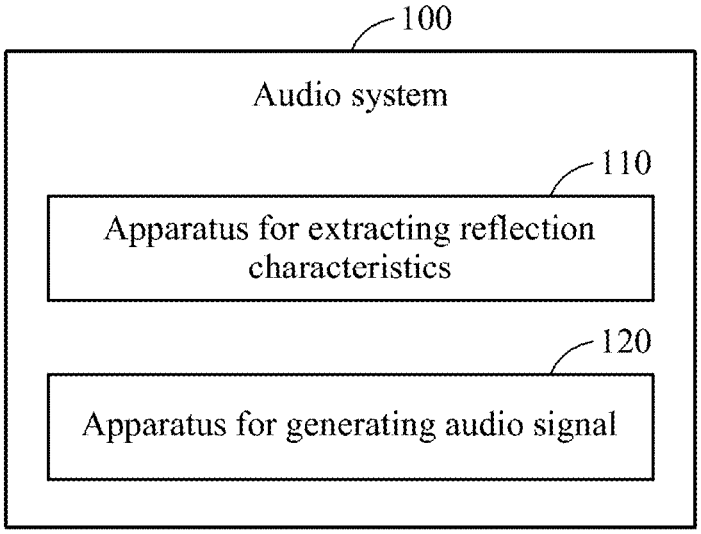
FIG. 1 is a block diagram illustrating an audio system according to an embodiment.

Reference will now be made in detail to embodiments of the present invention, examples of which are illustrated in the accompanying drawings, wherein like reference numerals refer to the like elements throughout. Embodiments are described below to explain the present invention by referring to the figures.

FIG. 1 is a block diagram illustrating an audio system according to an embodiment.

An audio system 100 according to an embodiment may reproduce a sound field by outputting a multi-channel audio signal through a plurality of speakers.

Referring to FIG. 1, the audio system 100 may include an apparatus 110 for extracting reflection characteristics, and an apparatus 120 for generating an audio signal.

The apparatus 110 for extracting reflection characteristics may extract reflection characteristics of a space in which the audio system 100 is installed based on a detection signal. A sound signal output through a speaker based on the detection signal may be a non-directional signal. Further, the detection signal may be used to change a polarity of at least one of channels corresponding to respective speakers, or to activate/deactivate at least one of the channels based on a modulation code.

The reflection characteristics of the space may indicate changes occurring when sound signals simultaneously output through the plurality of speakers are reflected by a wall of the space. The reflection characteristics of the space may change based on a number of the speakers outputting the sound signals. A detailed configuration and operation of the apparatus 110 for extracting reflection characteristics will be described in detail with reference to FIG. 2.

The apparatus 120 for generating an audio signal may generate an audio signal optimized for the space by modulating an audio signal based on the extracted reflection characteristics. The apparatus 120 for generating an audio signal may output sound signals generated based on the optimized audio signal through the speakers, thereby reproducing a sound field optimized for the space.

Figure 2:
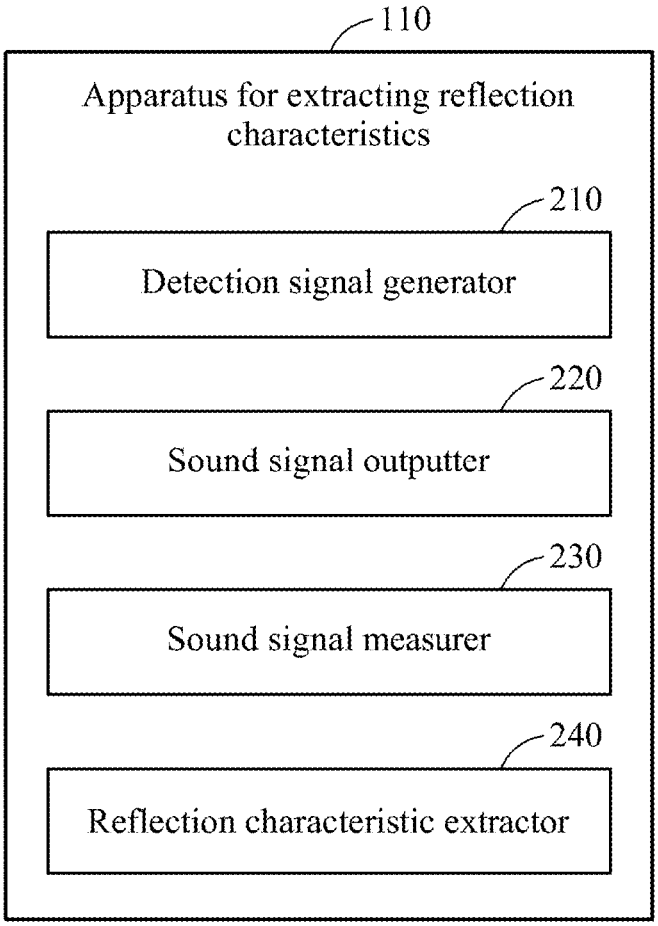
FIG. 2 is a block diagram illustrating an apparatus for extracting reflection characteristics in an audio system according to an embodiment.

FIG. 2 is a block diagram illustrating an apparatus for extracting reflection characteristics in an audio system according to an embodiment.

Referring to FIG. 2, the apparatus 110 for extracting reflection characteristics may include a detection signal generator 210, a sound signal outputter 220, a sound signal measurer 230, and a reflection characteristic extractor 240.

The detection signal generator 210 may generate a detection signal based on an input signal and a modulation code. The input signal may be a single-channel reference signal to be used to verify propagation characteristics of a sound signal between a sound sensor and speakers.

In detail, the detection signal generator 210 may generate a plurality of channels based on the single-channel input signal, and generate the detection signal by modulating at least one of the plurality of channels based on the modulation code. A number of the generated plurality of channels may correspond to a number of the speakers provided in a space in which the audio system 100 is installed.

For example, the detection signal generator 210 may generate the detection signal by reversing a polarity of at least one of the plurality of channels based on the modulation code. Further, the detection signal generator 210 may generate the detection signal by activating or deactivating at least one of the plurality of channels based on the modulation code.

The modulation code may be extracted from a digital code database (not shown). The detection signal generator 210 may generate a plurality of detection signals using digital modulation codes respectively corresponding to the plurality of channels. The detection signal generator 210 may extract accurate indoor reflection characteristics by generating such detection signals multiple times.

A digital modulation code may be information to be used to reverse a polarity of at least one of the plurality of channels, or to activate or deactivate at least one of the plurality of channels. For example, the digital modulation code may have one value of "a", "−a", or "0". The detection signal generator 210 may activate a channel corresponding to a digital modulation code of "a", reverse a polarity of a channel corresponding to a digital modulation code of "−a", and deactivate a channel corresponding to a digital modulation code of "0".

The plurality of detection signals generated based on the modulation codes may differ from one another in terms of whether to be activated, or a polarity, and thus may not include a phase difference or a time delay between the plurality of detection signals in the input signal.

The sound signal outputter 220 may generate sound signals having predetermined patterns based on the generated plurality of detection signals, and output the sound signals through the plurality of speakers. The speakers may be speakers included in the audio system 100 and configured to output multi-channel audio signals. For example, the speakers may be an array speaker being arranged in a line, 7.1 channel speakers, or 10.2 channel speakers.

Further, the sound signal outputter 220 may include multi-channel amplifiers configured to amplify the plurality of detection signals and transfer the amplified detection signals to the speakers. The sound signal output from the sound signal outputter 220 may be a non-directional signal generated based on a characteristic of the modulation code.

The sound signal outputter 220 may output the sound signal through the plurality of speakers simultaneously based on the plurality of detection signals, thereby outputting a sound signal robust to external noise.

The sound signal measurer 230 may measure sound signals output through the plurality of speakers, or sound signals reflected by a wall of the space. The sound signal measurer 230 may measure sound signals reflected by the wall and sound signals not reflected by the wall, among the sound signals output through the speakers, using at least one sound sensor. Further, the sound sensor may be installed in a position at which a user is probably positioned.

The reflection characteristic extractor 240 may extract reflection characteristics of the space based on the measured sound signals and the modulation code. The extracted reflection characteristics may include propagation characteristics of the sound signals with respect to the plurality of speakers.

The apparatus 110 for extracting reflection characteristics may iteratively measure the output sound signals N times based on the detection signals respectively corresponding to the plurality of speakers, and extract the reflection characteristics of the space based on the sound signals iteratively measured N times.

The apparatus 110 for extracting reflection characteristics may generate a control parameter to control the audio signal or a response signal based on the extracted reflection characteristics. The apparatus 110 for extracting reflection characteristics may transfer the generated control parameter or the generated response signal to the apparatus 120 for generating an audio signal.

In detail, the detection signal generator 210 may generate N pattern sets with respect to the plurality of detection signals by combining digital modulation codes. The generated pattern sets may be pattern sets of digital modulation codes combined using different patterns.

The detection signal generator 210 may sequentially generate N different detection signals using the N pattern sets.

The sound signal outputter 220 may generate sound signals having predetermined patterns based on the N generated detection signals, and sequentially output the generated sound signals through the speakers.

The sound signal measurer 230 may measure the sequentially output sound signals. The measured sound signals may include sound signals reflected by the wall and sound signals not reflected by the wall.

The reflection characteristic extractors 240 may extract reflection characteristics of the space based on the N pattern sets, in detail, the combination of the digital modulation codes, and the measured sound signals.

Figure 3:
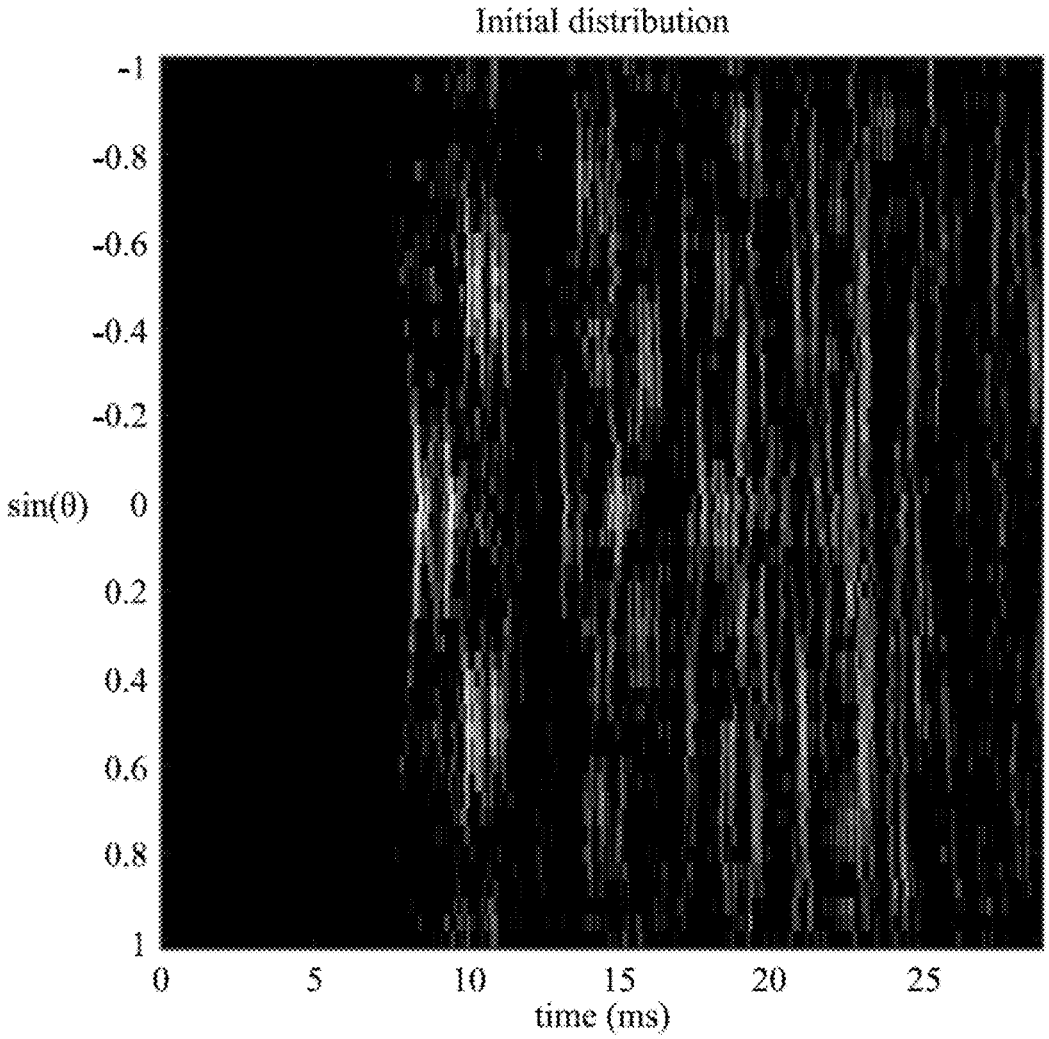
FIG. 3 illustrates a two-dimensional (2D) characteristic image of sound propagation with axes of a time and a radiation angle according to an embodiment.

For example, the reflection characteristic extractor 240 may generate a characteristic image of sound propagation as shown in FIG. 3, based on the N pattern sets and the measured sound signals. The characteristic image of sound propagation may be a two-dimensional (2D) characteristic image of sound propagation with axes of a time and a radiation angle.

Figure 4:
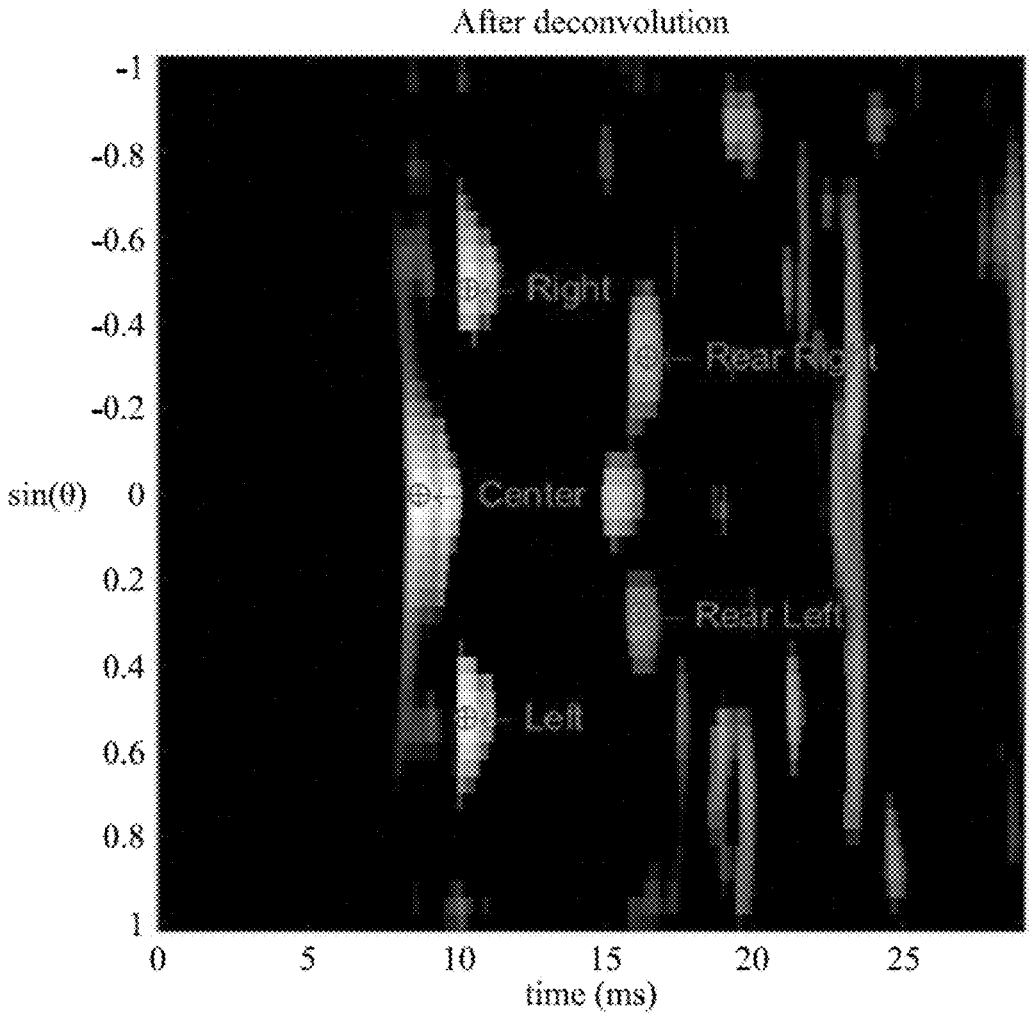
FIG. 4 illustrates a result of applying a feature point extracting algorithm to the 2D characteristic image of sound propagation of FIG. 3.

The reflection characteristic extractor 240 may extract the reflection characteristics of the space based on the characteristic image of sound propagation, as shown in FIG. 4. The reflection characteristic extractor 240 may predict positions of virtual speakers by applying a feature point extracting algorithm, such as image deconvolution and peak searching, for example, to the characteristic image of sound propagation.

In the examples of FIGS. 3 and 4, the reflection characteristic extractor 240 may predict the positions of the virtual speakers or optimal radiation angles of the respective speakers as shown in FIG. 4, by applying the feature point extracting algorithm to the characteristic image of sound propagation as shown in FIG. 3. For example, FIG. 4 shows positions of virtual speakers or optimal radiation angles in a case in which a virtual 5.1 channel speaker is provided.

The apparatus 110 for extracting reflection characteristics may measure sound signals output based on detection signals generated based on an input signal and a modulation code, and extract reflection characteristics of the based on the measured sound signals and the modulation code, thereby outputting an audio signal optimized for the space.

Figure 5:
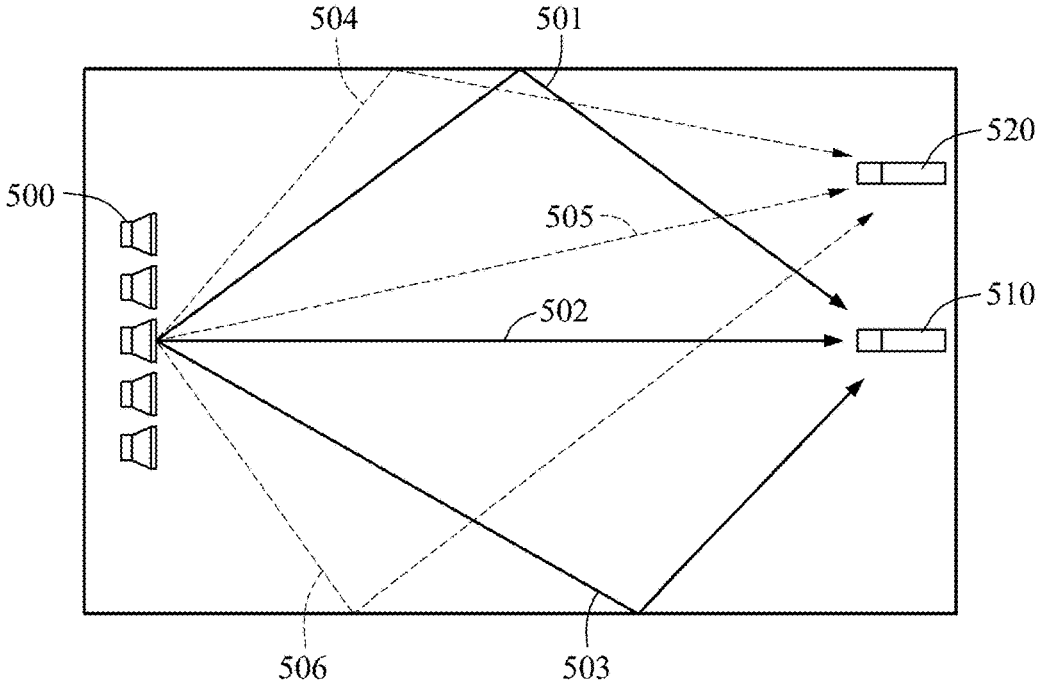
FIG. 5 is a diagram illustrating an example of a process of extracting reflection characteristics of a space in which an audio system is installed.

FIG. 5 is a diagram illustrating an example of a process of extracting reflection characteristics of a space in which an audio system is installed.

Speakers 500 in the audio system 100 may respectively output sound signals corresponding to a detection signal. In this example, at least one of the speakers 500 may be deactivated based on the detection signal to not output a sound signal. Further, at least one of the speakers 500 may output a sound signal with a polarity different from that of an input signal based on the detection signal.

The sound signal measurer 230 may dispose at least one sound sensor in a space in which the audio system 100 is installed. The at least one sound sensor may be installed at positions at which users are highly likely to be positioned. For example, a first sound sensor 510 may be installed at a center of the space at which users are most likely to be positioned. A second sound sensor 520 may be installed at a position different from that of the first sound sensor 510 to measure a sound signal at the corresponding position, thereby predicting a sound characteristic optimized for a user when the user is positioned near the second sound sensor 520.

Further, the sound signals measured by the sound sensors may be sound signals transferred directly to the sound sensors, or sound signals reflected by a wall, among the sound signals output through the speakers 500.

For example, the first sound sensor 510 may measure a sound signal 501 reflected by a wall on a right side of the space and transferred to the first sound sensor 510, a sound signal 502 transferred directly to the first sound sensor 510, and a sound signal 503 reflected by a wall on a left side of the space and transferred to the first sound sensor 510, among the sound signals output through the speakers 500. The second sound sensor 520 may measure a sound signal 504 reflected by the wall on the right side of the space and transferred to the second sound sensor 520, a sound signal 505 transferred directly to the second sound sensor 520, and a sound signal 506 reflected by the wall on the left side of the space and transferred to the second sound sensor 520, among the sound signals output through the speakers 500.

Since the first sound sensor 510 and the second sound sensor 520 are installed at different positions, propagation times and distances of the sound signals 501 through 506 output from the speakers 500 and transferred to the respective sound sensors may differ from one another. Thus, a portion of parameters of the sound signals 501 through 506 may differ from one another.

The reflection characteristic extractor 240 may extract reflection characteristics of the space by comparing a parameter varying based on the sound signals 501 through 506 reflected and modulated by the wall with a modulation code used to generate the sound signals 501 through 506.

Figure 6:
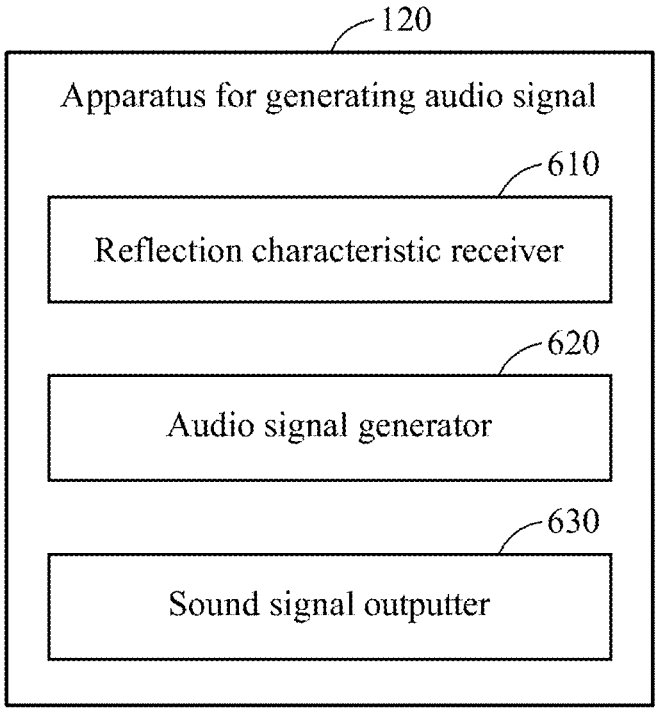
FIG. 6 is a block diagram illustrating an apparatus for generating an audio signal in an audio system according to an embodiment.

FIG. 6 is a block diagram illustrating an apparatus for generating an audio signal in an audio system according to an embodiment.

Referring to FIG. 6, the apparatus 120 for generating an audio signal may include a reflection characteristic receiver 610, an audio signal generator 620, and a sound signal outputter 630.

The reflection characteristic receiver 610 may receive reflection characteristics of a space in which the audio system 100 is installed. The received reflection characteristics may be reflection characteristics extracted by the apparatus 110 for extracting reflection characteristics. In detail, the reflection characteristic receiver 610 may receive a control parameter to control an audio signal or a response signal generated based on the extracted reflection characteristics.

The audio signal generator 620 may generate an audio signal optimized for the space by modulating an audio signal based on the received reflection characteristics. The audio signal may be a multi-channel audio signal including a plurality of channels.

In a case in which the apparatus 110 for extracting reflection characteristics and the apparatus 120 for generating an audio signal are configured as a single apparatus, the audio signal generator 620 may include the function of the reflection characteristic receiver 610.

The sound signal outputter 630 may generate a sound signal based on the optimized audio signal, and output the generated sound signal through the speakers in the audio system 100. The sound signal outputter 630 may have the same configuration as the sound signal outputter 220 of the apparatus 110 for extracting reflection characteristics.

The apparatus 120 for generating an audio signal may modulate and output the audio signal based on the extracted reflection characteristics, thereby outputting the audio signal optimized for the space.

Figure 7:
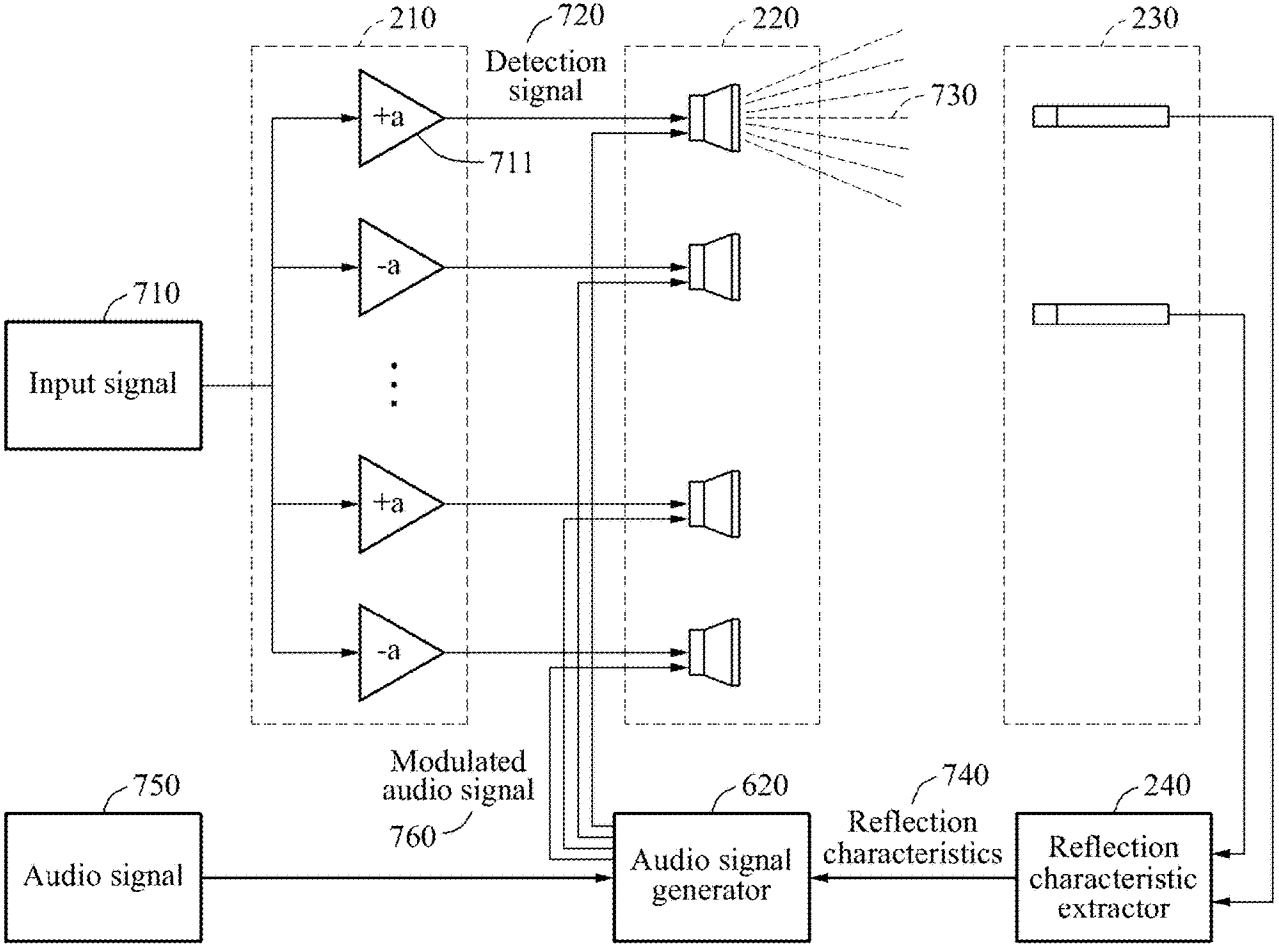
FIG. 7 is a diagram illustrating an example of an audio system according to an embodiment.

FIG. 7 is a diagram illustrating an example of an audio system according to an embodiment.

The apparatus 110 for extracting reflection characteristics and the apparatus 120 for generating an audio signal may be configured as separate apparatuses, or configured as a single apparatus. FIG. 7 illustrates a configuration and operation of the audio system 100 in a case in which the audio system 100 is a single apparatus including both the apparatus 110 for extracting reflection characteristics and the apparatus 120 for generating an audio signal.

Referring to FIG. 7, the audio system 100 may include the detection signal generator 210, the sound signal outputter 220, the sound signal measurer 230, the reflection characteristic extractor 240, and the audio signal generator 620.

The detection signal generator 210 may generate N pattern sets by combining digital modulation codes. The generated pattern sets may be pattern sets of digital modulation codes combined using different patterns. In addition, a number of digital modulation codes included in a pattern set may be determined based on a number of channels respectively corresponding to a plurality of speakers.

For example, FIG. 8 illustrates an example of a pattern set in which digital modulation codes are combined. The detection signal generator 210 may generate N pattern sets 800 by combining digital modulation codes. The N pattern sets 800 may be configured using a combination of different patterns.

Each pattern set 810 of the N pattern sets 800 may be determined based on a number of channels respectively corresponding to the plurality of speakers. In detail, the audio system of FIG. 8 may include a total of eight speakers.

The detection signal generator 210 may receive a single-channel input signal 710. The detection signal generator 210 may generate a plurality of detection signals 720 by applying at least one of the N pattern sets to the single-channel input signal 710.

The detection signals 720 may be used to reverse a polarity of at least one of the plurality of speakers, or to activate/deactivate at least one of the plurality of speakers based on the digital modulation codes included in the pattern sets.

The sound signal outputter 220 may generate a sound signal 730 based on the detection signals 720, and output the generated sound signal 730 through the plurality of speakers. In this example, a speaker receiving a detection signal to reverse a polarity may output a polarity-reversed sound signal 730. A speaker receiving a detection signal to deactivate a channel may not output the sound signal 730.

The sound signal measurer 230 may measure sound signals 730 output from the sound signal outputter 220. The measured sound signals 730 may include both sound signals reflected by a wall and sound signals not reflected by the wall.

The reflection characteristic extractor 240 may predict reflection characteristics 740 of a space in which the audio system 100 is installed based on the modulation codes and the measured sound signals 730. In this example, the reflection characteristic extractor 240 may iterate the process of generating the detection signals 720 and measuring the output sound signals 730 N times. The reflection characteristic extractor 240 may extract the reflection characteristics 740 of the space based on the sound signals 730 iteratively measured N times and the modulation codes.

The audio signal generator 620 may receive the reflection characteristics 740 from the reflection characteristic extractor 240. The reflection characteristics 740 transmitted from the reflection characteristic extractor 240 to the audio signal generator 620 may include at least one of a control parameter to control an audio signal and a response signal generated based on the extracted reflection characteristics 740.

The audio signal generator 620 may receive an audio signal 750 to be played back through the audio system 100. The audio signal generator 620 may generate an audio signal 760 optimized for the space by modulating the audio signal 750 based on the received reflection characteristics 740.

The audio signal generator 620 may transmit the modulated audio signal 760 to the audio signal outputter 220. The audio signal outputter 220 may generate a sound signal based on the received audio signal 760, and output the generated sound signal through the plurality of speakers, thereby reproducing a sound field optimized for the space.

Figure 9:
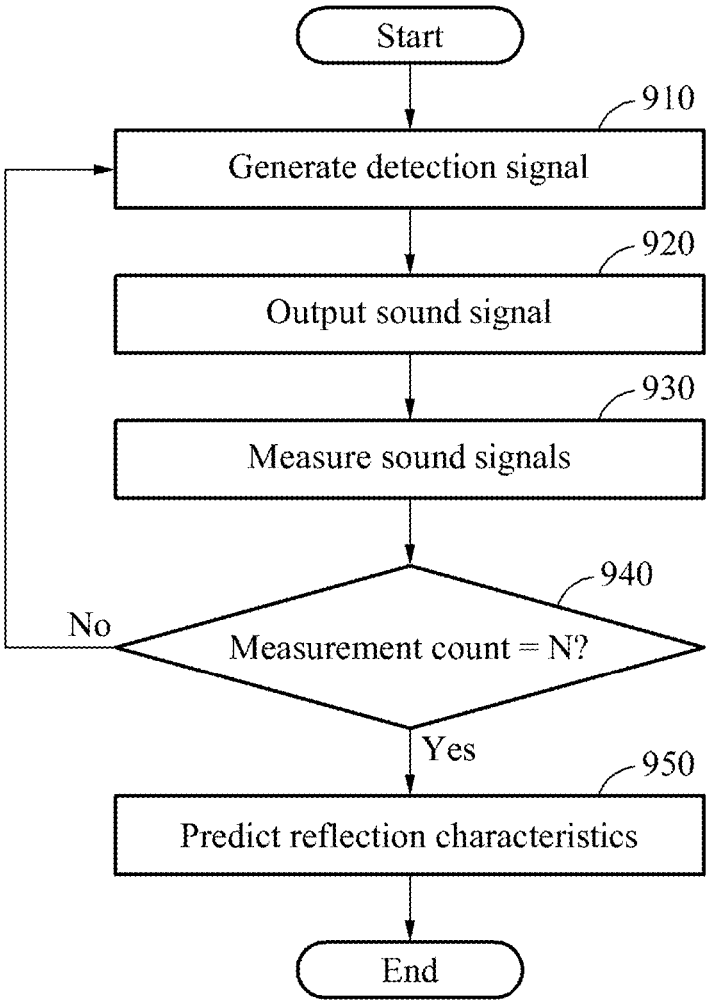
FIG. 9 is a flowchart illustrating a method of extracting reflection characteristics according to an embodiment.

FIG. 9 is a flowchart illustrating a method of extracting reflection characteristics according to an embodiment.

Referring to FIG. 9, in operation 910, the detection signal generator 210 may generate a detection signal based on an input signal and a modulation code. The input signal may be a single-channel reference signal to be used to verify propagation characteristics of a sound signal between a sound sensor and speakers.

In detail, the detection signal generator 210 may generate a plurality of channels based on the single-channel input signal, and generate the detection signals by modulating at least one of the plurality of channels based on the modulation code. A number of the generated plurality of channels may correspond to a number of the speakers provided in a space in which the audio system 100 is installed.

In operation 920, the sound signal outputter 220 may generate sound signals having predetermined patterns based on a plurality of detection signal generated in operation 910, and output the sound signals through the plurality of speakers. The sound signals output from the sound signal outputter 220 may be non-directional signals generated based on characteristics of the modulation code.

In operation 930, the sound signal measurer 230 may measure sound signals output through the speakers, or sound signals reflected by a wall of the space. The sound signal measurer 230 may measure sound signals reflected by the wall and sound signals not reflected by the wall, among the sound signals output through the speakers, using at least one sound sensor.

In operation 940, the reflection characteristic extractor 240 may verify whether the sound signal measurer 230 measures sound signals N times. Here, N denotes a preset iteration count for measuring sound signals, and a number of pattern sets of digital modulation codes to be used to generate detection signals.

In a case in which the sound signal measurer 230 measures sound signals less than N times, the reflection characteristic extractor 240 may control the sound signal measurer 230 to iteratively perform operations 910 through 930 until the sound signal measurer 230 measures sound signals N times. In a case in which the sound signal measurer 230 measures sound signals N times, the reflection characteristic extractor 240 may perform operation 950.

In operation 950, the reflection characteristic extractor 240 may extract reflection characteristics of the space based on the sound signals measured N times and the modulation codes.

For example, the reflection characteristic extractor 240 may generate a characteristic image of sound propagation as shown in FIG. 3, based on the sound signals measured N times and the modulation codes. The characteristic image of sound propagation may be a 2D characteristic image of sound propagation with axes of a time and a radiation angle. The reflection characteristic extractor 240 may extract the reflection characteristics of the space based on the characteristic image of sound propagation, as shown in FIG. 4. The reflection characteristic extractor 240 may predict positions of virtual speakers by applying a feature point extracting algorithm, such as image deconvolution and peak searching, for example, to the characteristic image of sound propagation.

In the examples of FIGS. 3 and 4, the reflection characteristic extractor 240 may predict the positions of the virtual speakers or optimal radiation angles of the respective speakers as shown in FIG. 4, by applying the feature point extracting algorithm to the characteristic image of sound propagation as shown in FIG. 3. For example, FIG. 4 shows positions of virtual speakers or optimal radiation angles in a case in which a virtual 5.1 channel speaker is provided.

Figure 10:
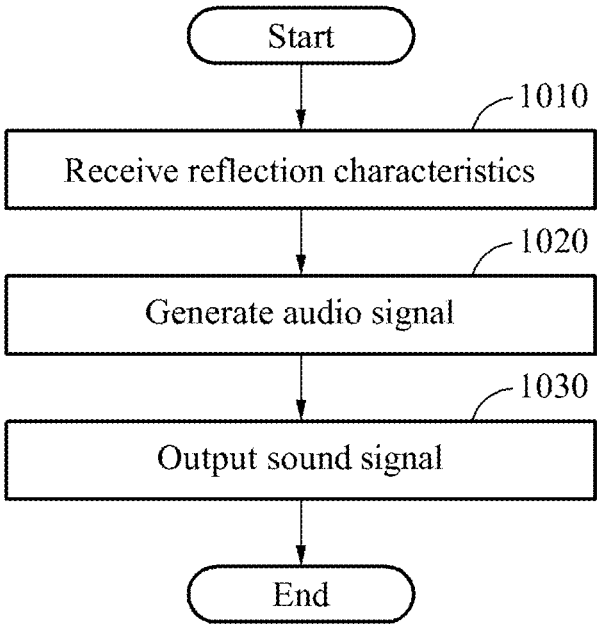
FIG. 10 is a flowchart illustrating a method of generating an audio signal according to an embodiment.

FIG. 10 is a flowchart illustrating a method of generating an audio signal according to an embodiment.

Referring to FIG. 10, in operation 1010, the reflection characteristic receiver 610 may receive reflection characteristics of a space in which the audio system 100 is installed. The received reflection characteristics may be reflection characteristics extracted by the apparatus 110 for extracting reflection characteristics. In detail, the reflection characteristic receiver 610 may receive a control parameter to control an audio signal or a response signal generated based on the extracted reflection characteristics.

In operation 1020, the audio signal generator 620 may generate an audio signal optimized for the space by modulating an audio signal based on the received reflection characteristics. The audio signal may be a multi-channel audio signal including a plurality of channels.

In operation 1030, the sound signal outputter 630 may generate a sound signal based on the optimized audio signal, and output the generated sound signal through the speakers in the audio system 100.

According to an embodiment, by measuring sound signals output based on detection signals generated based on an input signal and a modulation code, and extracting reflection characteristics of a space in which an audio system is installed based on the measured sound signals and the modulation code, an audio signal optimized for the space may be output.

According to an embodiment, by outputting sound signals through a plurality of speakers simultaneously based on a detection signal, a sound signal robust to external noise may be output.

The methods according to the above-described embodiments may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tapes; optical media such as CD ROMs and DVDs; magneto-optical media such as floptical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments of the present invention, or vice versa.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method of extracting reflection characteristics, the method comprising:

generating a detection signal based on an input signal and a modulation code;

outputting sound signals generated based on the detection signal through speakers;

measuring direct sound signals, among the output sound signals, directly from the speakers, or reflected sound signals, among the output sound signals, which are reflected by a wall of a space in which the speakers are installed;

extracting reflection characteristics of the space based on the measured direct or reflected sound signals and the modulation code, wherein the extracting comprises generating a characteristic image of sound propagation based on the measured direct or reflected sound signals and the modulation code, and verifying the reflection characteristics of the space based on the characteristic image of sound propagation by applying a feature point extracting algorithm to the generated characteristic image of sound propagation; and outputting a sound signal which is optimized for the space based on the extracted reflection characteristics through the speakers.

2. The method of claim 1, wherein the generating of the detection signal comprises generating channels based on the input signal, which is a single-channel input signal, and generating the detection signal by modulating at least one of the channels based on the modulation code.

3. The method of claim 1, wherein the generating of the detection signal comprises generating the detection signal by reversing a polarity of at least one channel based on the modulation code.

4. The method of claim 1, wherein the generating of the detection signal comprises generating the detection signal by activating at least one channel based on the modulation code.

5. The method of claim 1, wherein the modulation code comprises a digital modulation code to control whether channels are to be activated or deactivated, or whether polarities of the channels are to be reversed.

6. The method of claim 1, wherein the modulation code is configured using a combination of codes to respectively to control whether the channels are to be activated or deactivated, or whether polarities of the channels are to be reversed.

7. The method of claim 1, wherein the outputting comprises generating a non-directional signal based on the detection signal, and outputting the non-directional signal through the speakers.

8. The method of claim 1, wherein the generating of the characteristic image of sound propagation comprises generating a two-dimensional (2D) characteristic image of sound propagation with axes of time and a radiation angle.

9. A method of generating an audio signal, the method comprising:

receiving reflection characteristics of a space in which speakers are installed, wherein the reflection characteristics are extracted by generating a two-dimensional (2D) characteristic image of sound propagation with axes of lime and a radiation angle based on a first sound signal and a modulation code, and applying a feature point extracting algorithm to the characteristic image of sound propagation;

generating an audio signal optimized for the space by modulating an audio signal based on the reflection characteristics;

generating a second sound signal based on the optimized audio signal; and outputting the second sound signal through the speakers.

10. The method of claim 9, wherein the first sound signal is generated based on a detection signal generated based on an input signal and the modulation code.

11. An apparatus to extract reflection characteristics, the apparatus comprising:

a detection signal generator configured to generate a detection signal based on an input signal and a modulation code;

a sound signal outputter configured to generate sound signals based on the detection signal, and to output the generated sound signals through speakers;

a sound signal measurer configured to measure direct sound signals, among the output generated sound signals, directly from the speakers, or reflected sound signals, among the output generated sound signals, which are reflected by a wall of a space in which the speakers are installed; and a reflection characteristic extractor configured to extract reflection characteristics of the space based on the measured direct or reflected sound signals and the modulation code, to generate a two-dimensional (2D) characteristic image of sound propagation with axes of time and a radiation angle based on the measured direct or reflected sound signals and the modulation code, and to verify the reflection characteristics of the space by applying a feature point extracting algorithm to the 2D characteristic image of sound propagation, and wherein the sound signal outputter is further configured to output a sound signal which is optimized for the space based on the extracted reflection characteristics through the speakers.

12. The apparatus of claim 11, wherein the detection signal generator is further configured to generate channels based on the input signal, which is a single-channel input signal, and to generate the detection signal by modulating at least one of the channels based on the modulation code.

13. The apparatus of claim 11, wherein the detection signal generator is further configured to generate the detection signal by reversing a polarity of at least one channel based on the modulation code.

14. The apparatus of claim 11, wherein the detection signal generator is configured to generate the detection signal by activating at least one channel based on the modulation code.

15. The apparatus of claim 11, wherein the sound signal outputter is further configured to generate a non-directional signal based on the detection signal, and to output the non-directional signal through the speakers.

* * * * *